US008052369B2

(12) United States Patent
Often et al.

(10) Patent No.: US 8,052,369 B2
(45) Date of Patent: Nov. 8, 2011

(54) DEVICE FOR STORING TUBULARS AND DEVICES FOR HANDLING OF TUBULARS

(75) Inventors: Ola Often, Stabekk (NO); Sondre Hagen, Oslo (NO)

(73) Assignee: Fred Olsen Energy ASA, Oslo (NO)

( * ) Notice: Subject to any disclaimer, the term of this patent is extended or adjusted under 35 U.S.C. 154(b) by 195 days.

(21) Appl. No.: 11/992,600

(22) PCT Filed: Sep. 25, 2006

(86) PCT No.: PCT/NO2006/000330

§ 371 (c)(1),
(2), (4) Date: Mar. 26, 2008

(87) PCT Pub. No.: WO2007/035113

PCT Pub. Date: Mar. 29, 2007

(65) Prior Publication Data

US 2009/0136327 A1 May 28, 2009

(30) Foreign Application Priority Data

Sep. 26, 2005 (NO) ..... 20054447

(51) Int. Cl.
*E21B 19/06* (2006.01)
*E21B 19/04* (2006.01)

(52) U.S. Cl. ..... 414/22.55; 414/22.51; 414/22.68; 414/22.63

(58) Field of Classification Search ..... 114/264; 175/52, 85; 211/70.4; 212/231; 294/93, 294/97; 414/22.51–22.59, 22.61, 22.63–22.69, 414/2.71, 626, 910

See application file for complete search history.

(56) References Cited

U.S. PATENT DOCUMENTS 2,999,549 A * 9/1961 Stratton ..... 175/5
3,268,092 A * 8/1966 Hainer et al. ..... 414/729
3,706,347 A 12/1972 Brown (Continued)

FOREIGN PATENT DOCUMENTS

CA 2 419 885 8/2003

(Continued)

OTHER PUBLICATIONS

International Search Report for PCT/NO2006/000330 dated Sep. 4, 2007.

(Continued)

*Primary Examiner* — Gregory Adams
(74) *Attorney, Agent, or Firm* — Nixon & Vanderhye PC

(57) ABSTRACT

Device for storing tubular on a drilling and/or production installation, comprising a shaft (8, 9, 10, 11) to accommodate a plurality of tubular in a substantially vertical position and a guide (15, 22) that is moveable above the shaft (8, 9, 10, 11). The device comprises means for displacing the guide (15, 22) in a substantially horizontal plane to a position above a selected one of all the tubular in the shaft. Also described are a catwalk (12) configured to displace the tubular in an axial direction through a V-door in the derrick (5), and which is further configured to be tilted into a substantially vertical position to receive or deliver a tubular, and a knuckle boom crane (7) with a grapple (27) that is adapted to grip an upper end of a substantially vertical tubular and carry the tubular in a substantially vertical orientation.

18 Claims, 11 Drawing Sheets

U.S. PATENT DOCUMENTS

Figure 1:
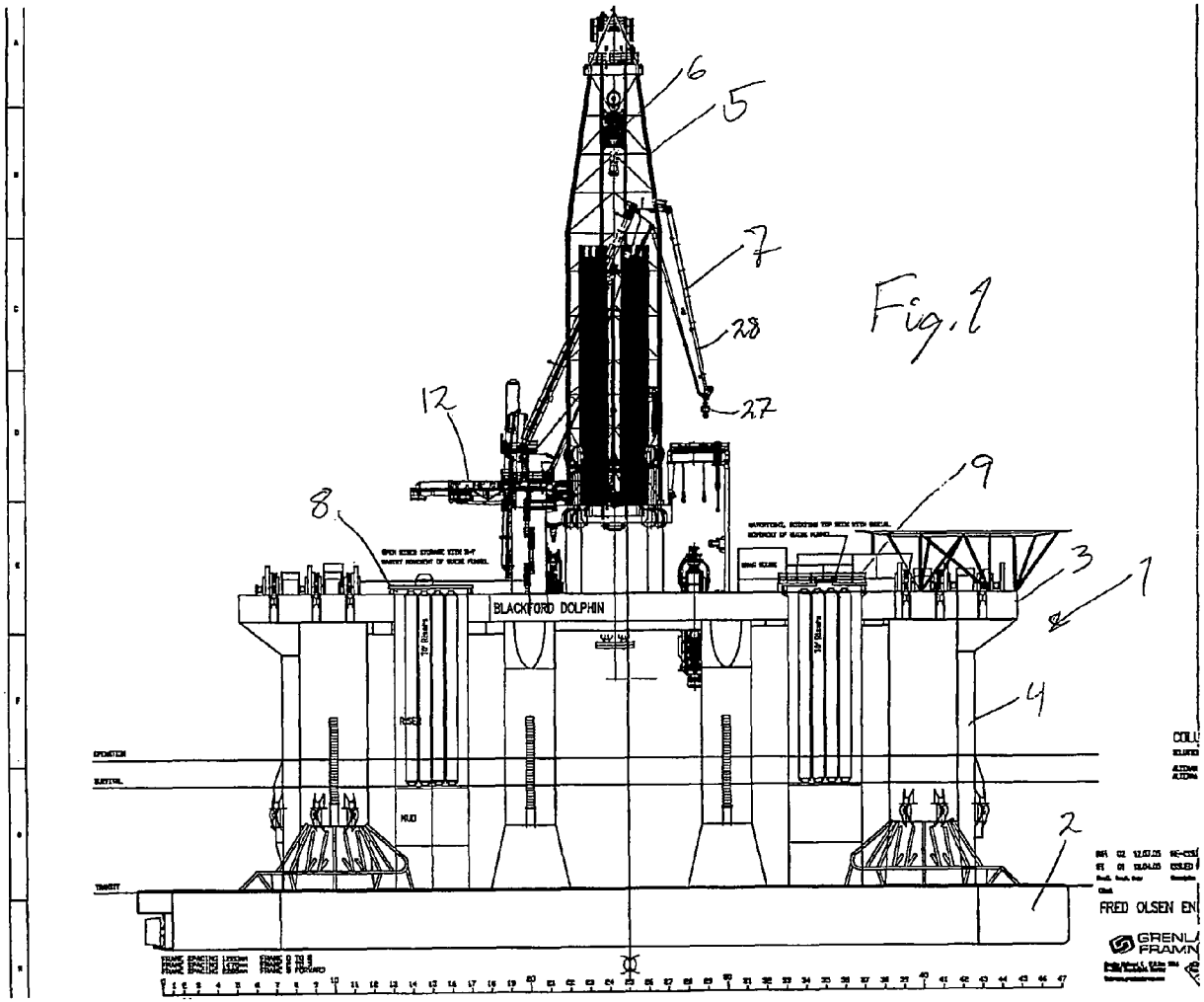

| | | | | |
|---|---|---|---|---|
| 3,981,369 | A | 9/1976 | Bokenkamp | |
| 3,987,910 | A * | 10/1976 | Brunato | 414/22.63 |
| 4,044,895 | A * | 8/1977 | Adair | 414/22.63 |
| 4,320,915 | A * | 3/1982 | Abbott et al. | 294/96 |
| 4,621,974 | A | 11/1986 | Krueger | |
| 4,660,729 | A * | 4/1987 | Carbert | 212/278 |
| 4,708,563 | A * | 11/1987 | Van Den Berg et al. | 414/22.66 |
| 4,725,179 | A | 2/1988 | Woolslayer et al. | |
| 4,762,185 | A * | 8/1988 | Simpson | 175/5 |
| 4,818,172 | A * | 4/1989 | Johnson | 414/686 |
| 4,834,604 | A | 5/1989 | Brittain et al. | |
| 6,089,333 | A | 7/2000 | Rise | |
| 6,524,049 | B1 * | 2/2003 | Minnes | 414/22.51 |
| 6,601,531 | B1 * | 8/2003 | Baylot et al. | 114/264 |
| 2003/0155154 | A1 | 8/2003 | Oser | |
| 2003/0159854 | A1 | 8/2003 | Simpson et al. | |
| 2005/0173154 | A1 * | 8/2005 | Lesko | 175/57 |
| 2008/0053704 | A1 * | 3/2008 | Zachariasen et al. | 175/52 |

FOREIGN PATENT DOCUMENTS

| | | |
|---|---|---|
| WO | 98/56652 | 12/1998 |
| WO | WO 9931346 A1 * | 6/1999 |
| WO | 2006/068497 | 12/2005 |

OTHER PUBLICATIONS

Norwegian Search Report dated Apr. 24, 2006 in Norwegian Application No. 20054447.

International Preliminary Report on Patentability for PCT/NO2006/000330 dated Sep. 4, 2007.

* cited by examiner

BLACKFORD DOLPHIN
FRED OLSEN
1
2
3
4
5
6
7
8
9
12
27
28

WATERTIGHT, ROTATING TOP DECK WITH RADIAL MOVEMENT OF GUIDE FUNNEL

RISER OPERATIONS

DEVICE FOR STORING TUBULARS AND DEVICES FOR HANDLING OF TUBULARS

This application is the U.S. national phase of International Application No. PCT/NO2006/000330 filed 25 Sep. 2006 which designated the U.S. and claims priority to Norwegian Application No. 20054447 filed 26 Sep. 2005, the entire contents of each of which are hereby incorporated by reference.

The present invention relates to devices for storage of tubulars on board a floating vessel as stated in the preamble of claim 1. It also relates to apparatuses for handling tubulars between a storage device and a derrick as stated in the preamble of claims 7 and 9.

Offshore oil and gas exploration and production is dependent on drilling from floating semisubmersible platforms or drillships. Many drilling units were built in the 70's for drilling in water depths down to 1500 ft (500 meters) ($2^{nd}$ and $3^{rd}$ generation), while as exploration has gone deeper, a number of drilling units have later been built for and operate in water depths beyond 5000 ft (1500 meters), the water depth record now standing at app. 10000 ft (3000 meters) ("ultra deep water") ($4^{th}$ and $5^{th}$ generation).

Down to app. 5000 ft, the rigs may be moored by combinations of chain and steel wire or synthetic rope, while in deeper water the drilling units are primarily kept in position by azimuth thruster propellers and dynamic positioning. Due to their high deck load capacity and suitability for dynamic positioning, the majority of ultra deep water drilling units is drill ships.

The drilling units utilize a 21" (533.5 mm) diameter steel riser to circulate drilling mud and cuttings back to surface for well control, cleaning and recirculation. The riser is bolted or clamped together from 50 to 80 ft (15-24 meters) long joints, typically equipped with syntactic foam buoyancy to obtain close to neutral weight in seawater.

Typically, the riser joints are individually added to or taken off the riser string on the drill floor, while the suspended lower part of the riser string, including blow out preventer (BOP), is hung off on a spider placed above the rotary table (the opening in the drillfloor which allows running of drill string and other tubulars). Riser joints are typically transported by crane or other pipe handling equipment to horizontal storage on deck, or to vertical or slanted storage racks at or above deck level. In either case, the drilling unit must provide space, buoyancy and stability for a large volume of riser pipe.

The higher day rates achieved in the market by the $4^{th}$ and $5^{th}$ generation deepwater drilling units makes upgrade of units with shallow water capacity an attractive option.

All deepwater upgrades mean more weight on the rig, and increased payload requirements. It is also evident that the biggest bottleneck in the utilization of a floating vessel is the riser storage volume and weight.

Current $4^{th}$ generation deepwater rigs have displacements up to twice that of the bulk of shallow water (1500 ft w.d) (500 meters water depth) rigs, with associated higher building costs.

There are known several different storage and handling systems for tubulars. Some of these are aimed at shifting the storage volume and weight distribution to a lower level in order to improve stability.

U.S. Pat. No. 3,339,747 shows a pipe rack for well drilling apparatus, wherein a pipe well for vertical storage of pipes is suspended from a drilling platform. The pipe well incorporates a wedge type of arrangement in the bottom for vertical movement of the risers.

U.S. Pat. No. 3,987,910 shows an apparatus for racking drill pipes on floater type platforms. This is an X-Y racking apparatus combined with a container located in the substructure area of the floating platform for supporting the pipes. In one embodiment the container is of a closed type for use on a drill ship. It protrudes below sea level, and also below the bottom of the hull to achieve greater stability. In another embodiment the container is of a structural kind for use on a semi-submersible, arranged at an elevation where medium severe waves will not have hard impact on the container.

The above system is very similar to the riser storage and handling system Borgland Dolphin, Bideford Dolphin and a number of other rigs.

U.S. Pat. No. 6,250,395 shows an apparatus system and method for installing and retrieving pipe in a well. The described system for storing and deploying long strings of jointed pipe adjacent to the drilling rig, is aiming at reducing the time spent to assemble and disassemble the pipe strings and also to reduce the payload requirements for the floating rig. The system incorporates a method to run the pipe string along a curvature higher than the yielding radius of the pipe, through more than 90 degrees, that is, from the vertical well to horizontal or vertical position, to be stored in water. Storage in water may be achieved in many forms, inside or outside carrier pipes, vertical or horizontal, suspended from rig or buoyed off on surface or in mid-water.

In this patent long sections of pipe string made up by assembling multiple joints end to end is moved over a large radius ramp from position in or above the well to a horizontally (through app. 90 degrees) or a vertically (through app. 180 degrees) submerged storage.

U.S. Pat. No. 2,606,003 shows a system for drilling from a floating drilling unit, incorporating a marine riser with two flexible joints and a slip joint (now standard marine riser technology), incorporating as a secondary feature, a storage container which is mounted within and extends below the floating barge to provide for the substantially vertical storage of drill pipe. The mounting of the pipe storage container places the contained pipe principally below the deck of the barge, thereby lowering the centre of gravity of the barge and tending to stabilize the barge under wave action.

U.S. Pat. No. 6,766,860 shows a system and means for hanging off an assembled string of tubulars (such as a full riser string) and skidding it away from the rotary to allow well operations outside the riser (such as running X-mas tree).

U.S. Pat. No. 6,524,049 shows a semi-submersible mobile drilling vessel with storage shaft for tubular drilling equipment, which is incorporating vertical storage of drilling tubulars inside one or more columns. This arrangement is being implemented two new Amethyst designs for Petrobras, providing storage for 24 pieces of 65 ft length 21" riser joints.

U.S. Pat. No. 4,646,672 shows a semi-submersible vessel incorporating a centrally located buoyant caisson with internal drilling moonpool and provisions for vertical riser storage inside the caisson.

This arrangement has been used on Transocean's Jack Bates, a Friede & Goldman L-1020 Trendsetter built 1986 in Japan for vertical storage of 87 joints of 60' long 21" riser.

U.S. Pat. No. 4,708,563 shows a platform with a plurality of cylindrical storage devices suspended from the platform deck. A retrieving device is running between the storage devices and the derrick to retrieve tubulars. The tubulars are guided along a ramp when they are retrieved. In each storage device is a turret in which the tubulars are suspended. The tubulars can thereby be rotated to a retrieving position.

U.S. Pat. No. 4,762,185 shows a vessel with two cylindrical storage devices within a circular hull. The tubulars are suspended in a rotatable magazine. Above each storage device is provided a trolley with a guiding ring, through which the tubulars are guided. The tubulars are lifted by the hoisting apparatus in the derrick.

The main object of the present invention is an efficient conversion of a $2^{nd}$ or $3^{rd}$ generation shallow water rated drilling semi-submersible rigs to deep water operations. This is achieved by mounting one or more tubular storage shafts to the rig as defined by the subsequent claim 1.

The shafts are preferably extending from the pontoon to deck level, each shaft incorporate facilities for vertical storage of riser joints. The riser storage arrangement lowers the centre of gravity of the stored risers, allowing better utilization of the rigs variable deck load capacity. Furthermore, deck storage area normally dedicated to riser storage is released for other purposes. As an additional effect, the shaft stability of the rig, and the shafts may be fitted with additional features such as liquid mud storage.

These and other features of the invention are evident from the dependent claims.

In addition to the storage columns, the invention includes devices for efficient handling of the riser joints between the drill centre to the riser storage areas.

Figure 2:
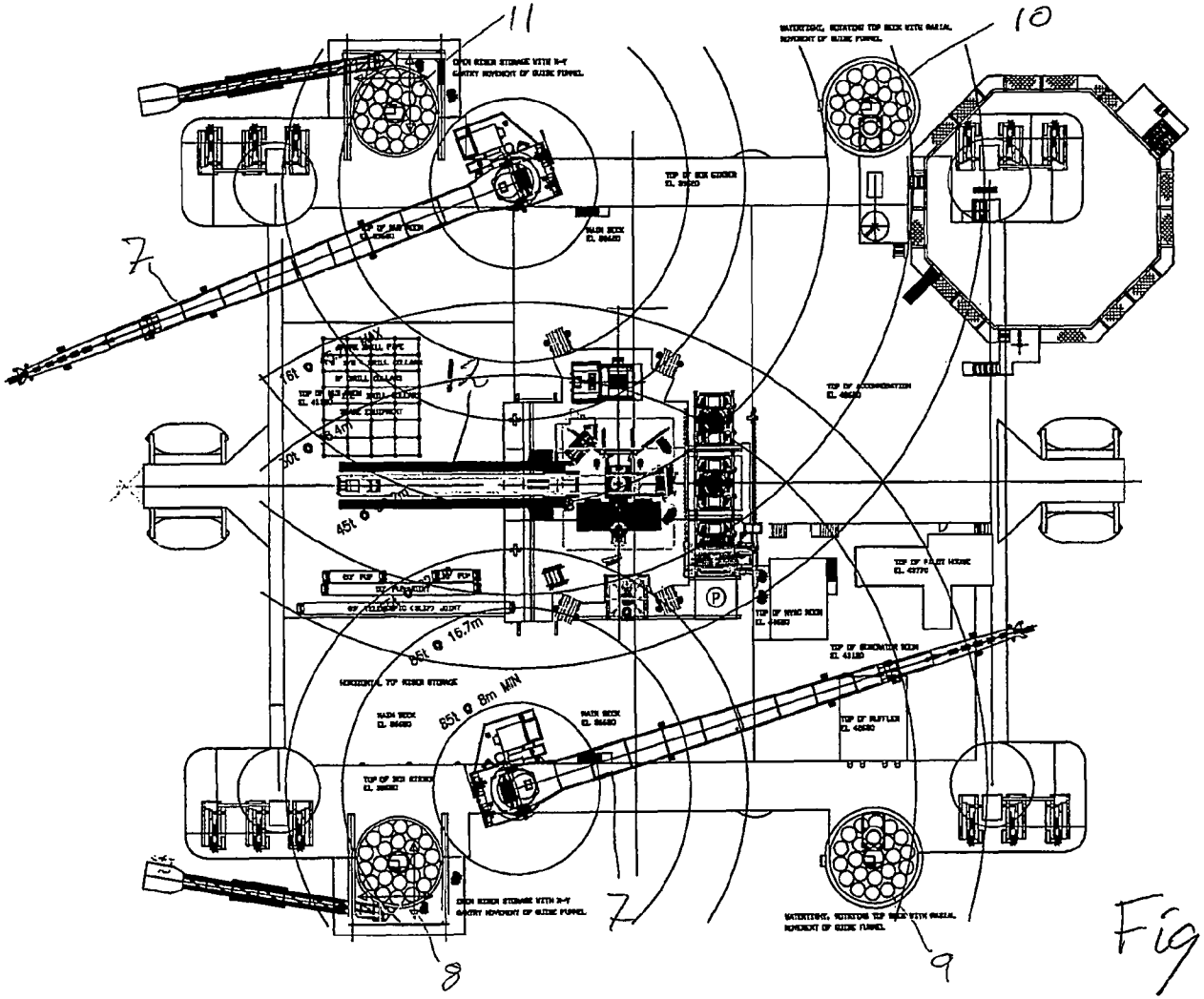
Figure 3A:
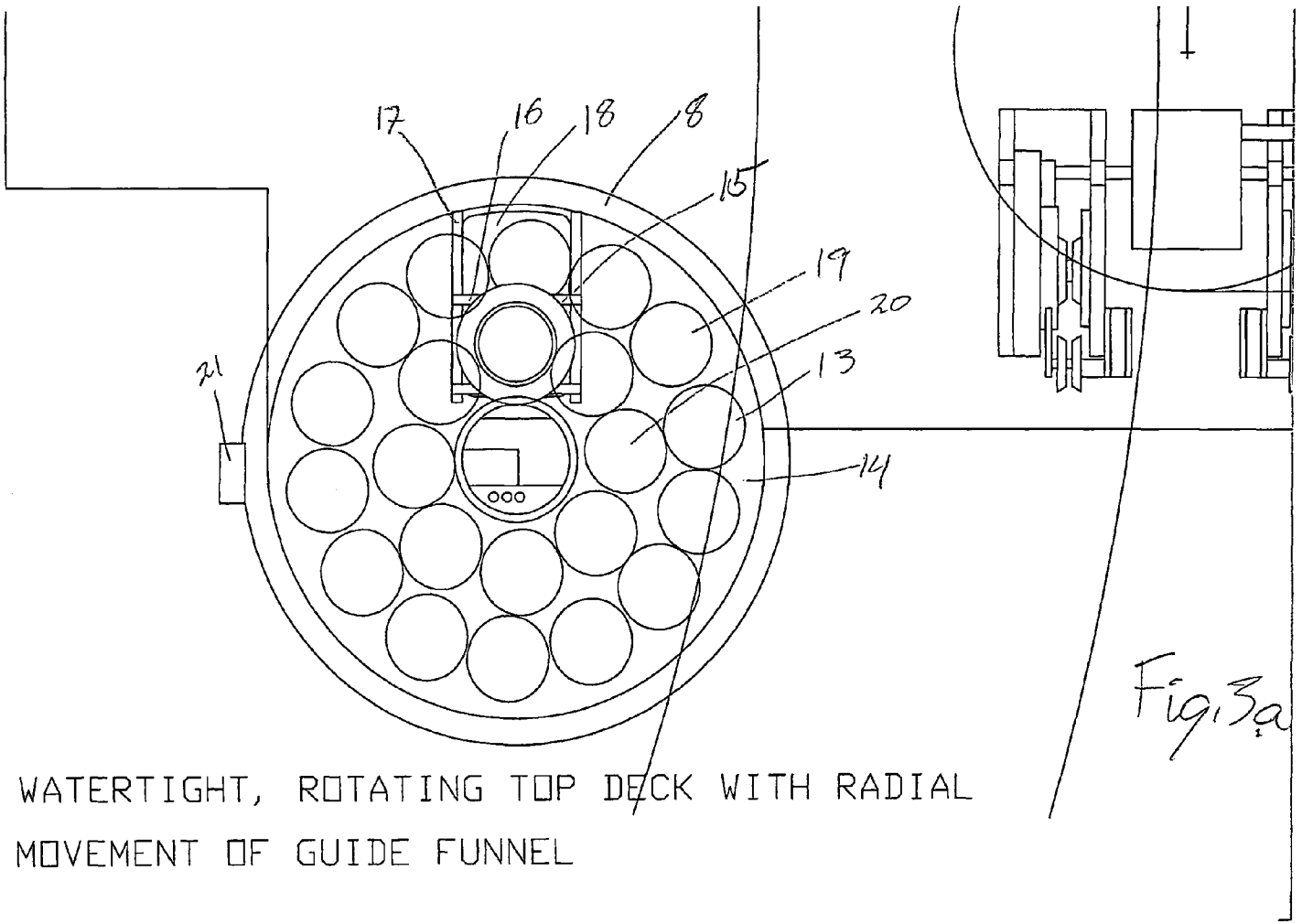
Figure 3B:
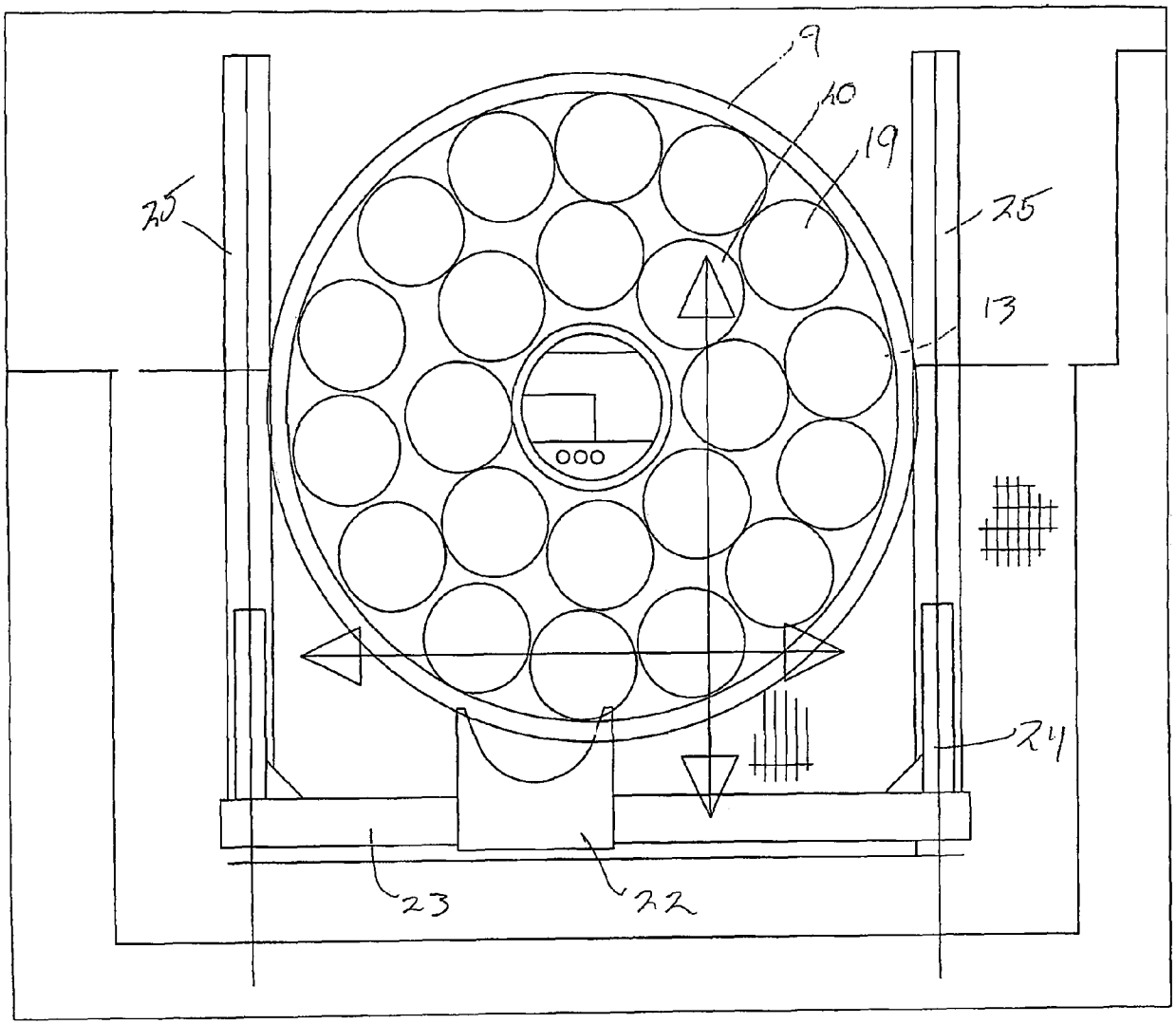
Figure 4A:
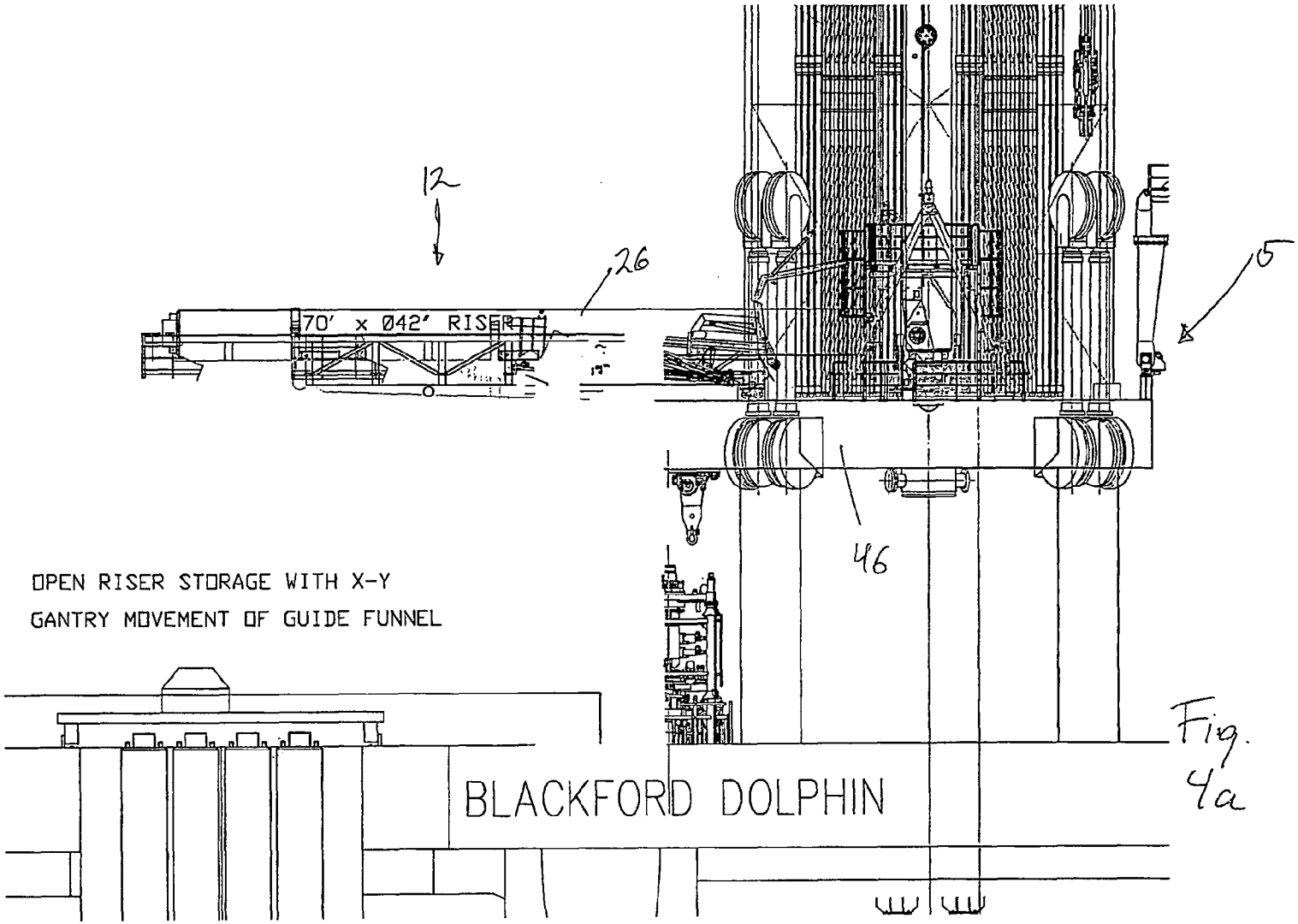
Figure 46:
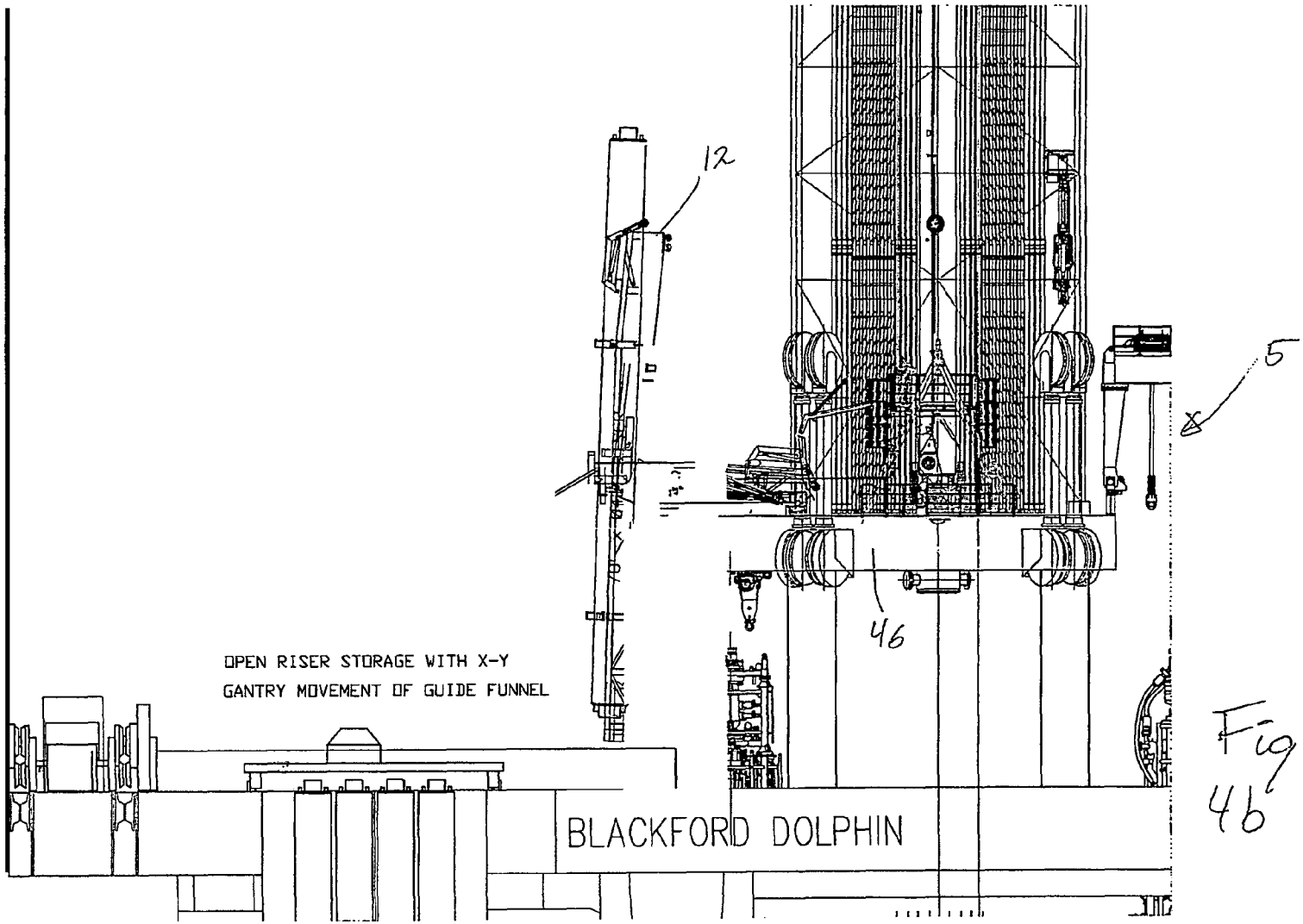
Figure 4E:
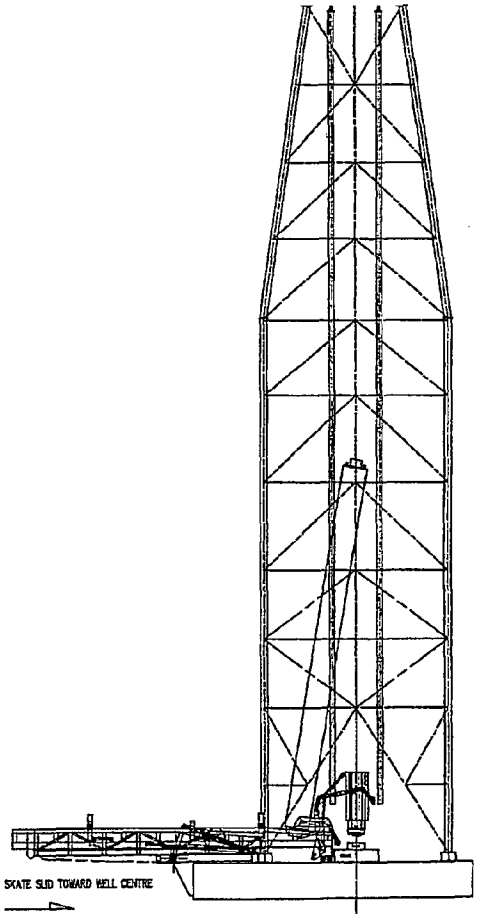
Figure 4D:
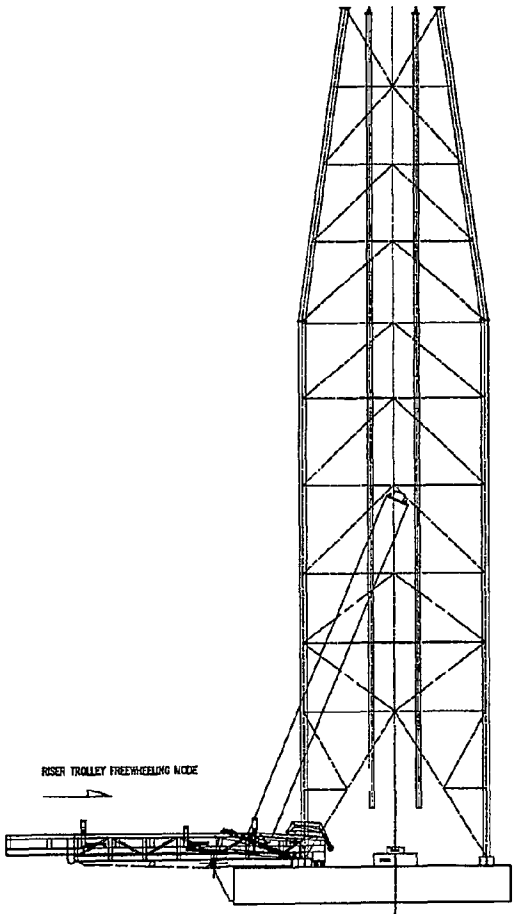
Figure 4C:
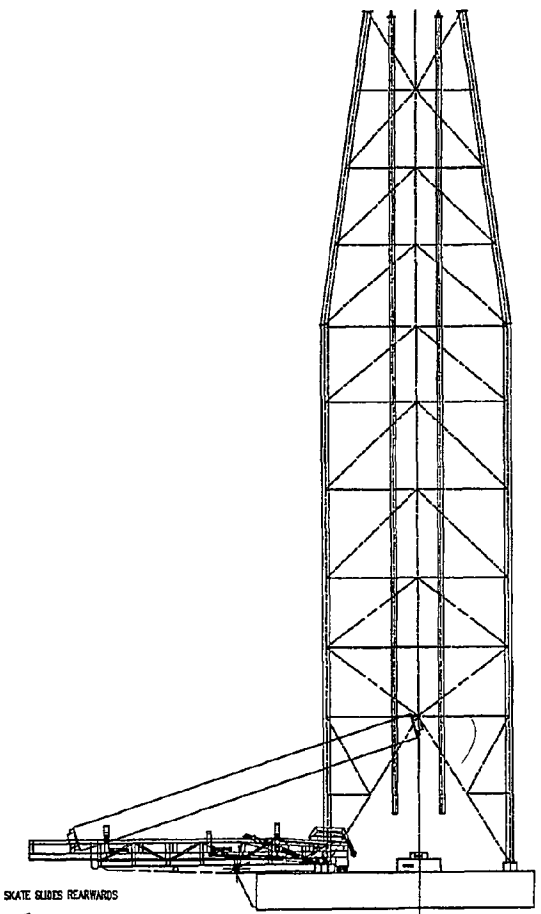
Figure 4A:
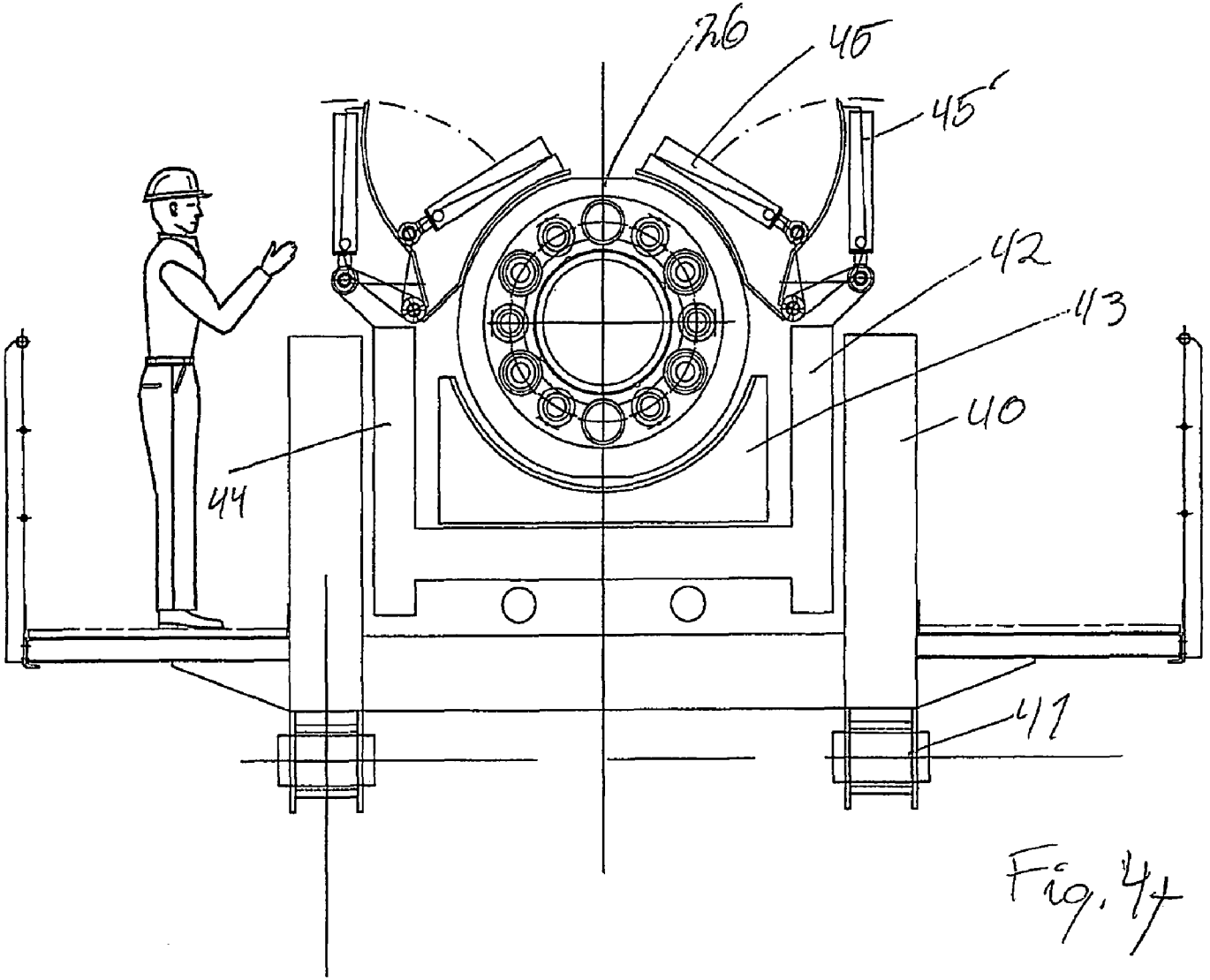
Figure 5:
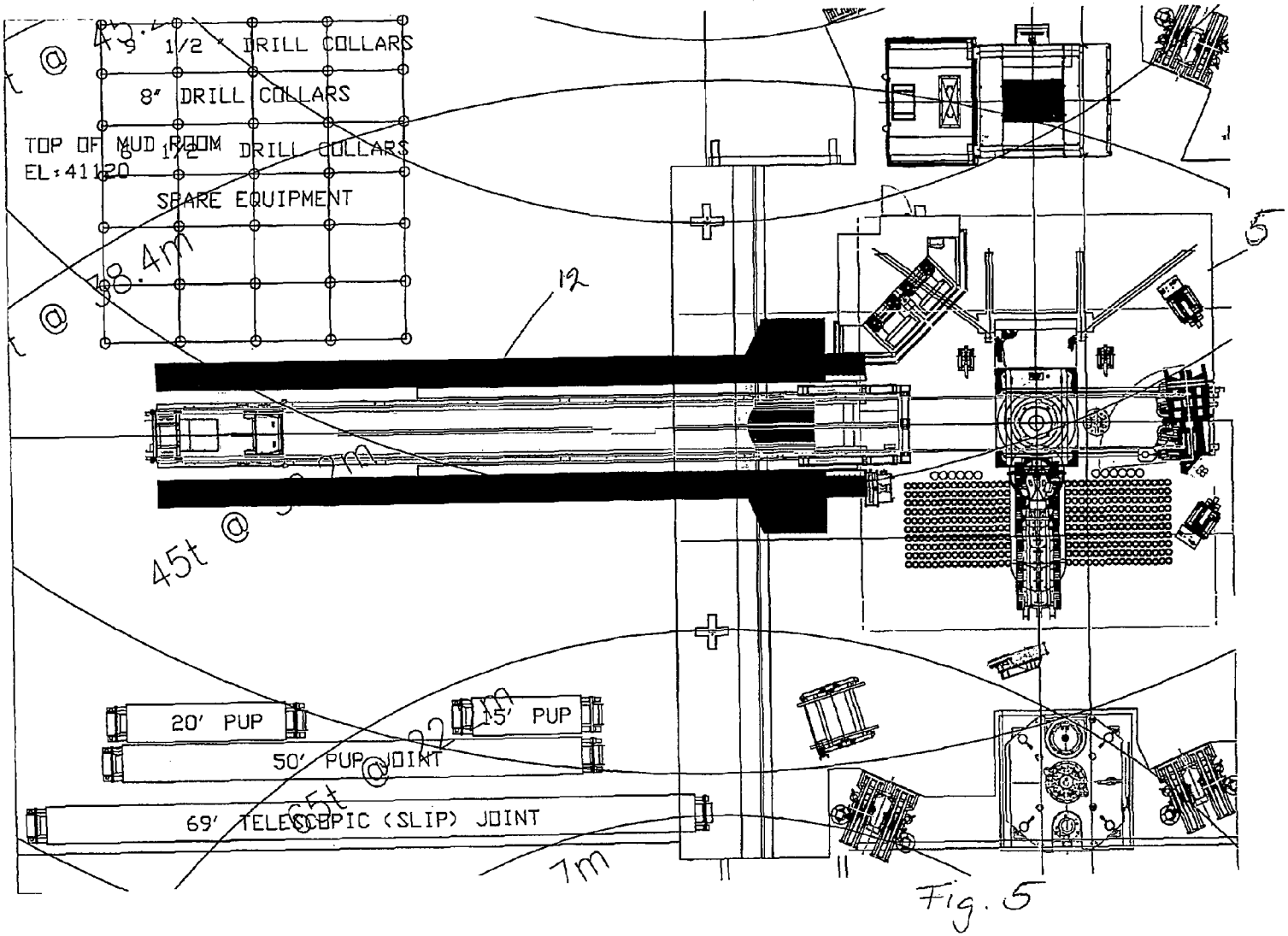
Figure 6:
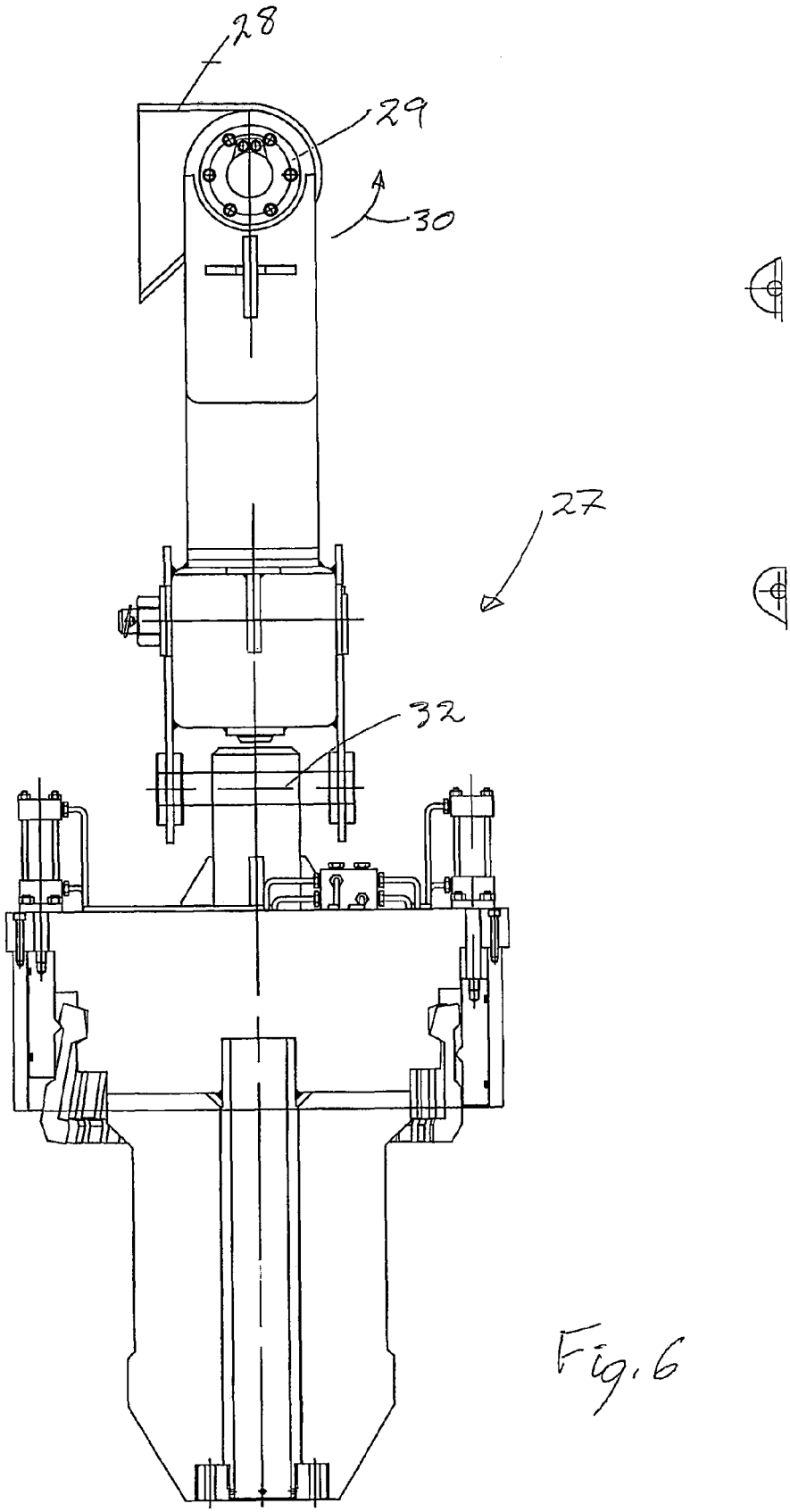
Figure 7:
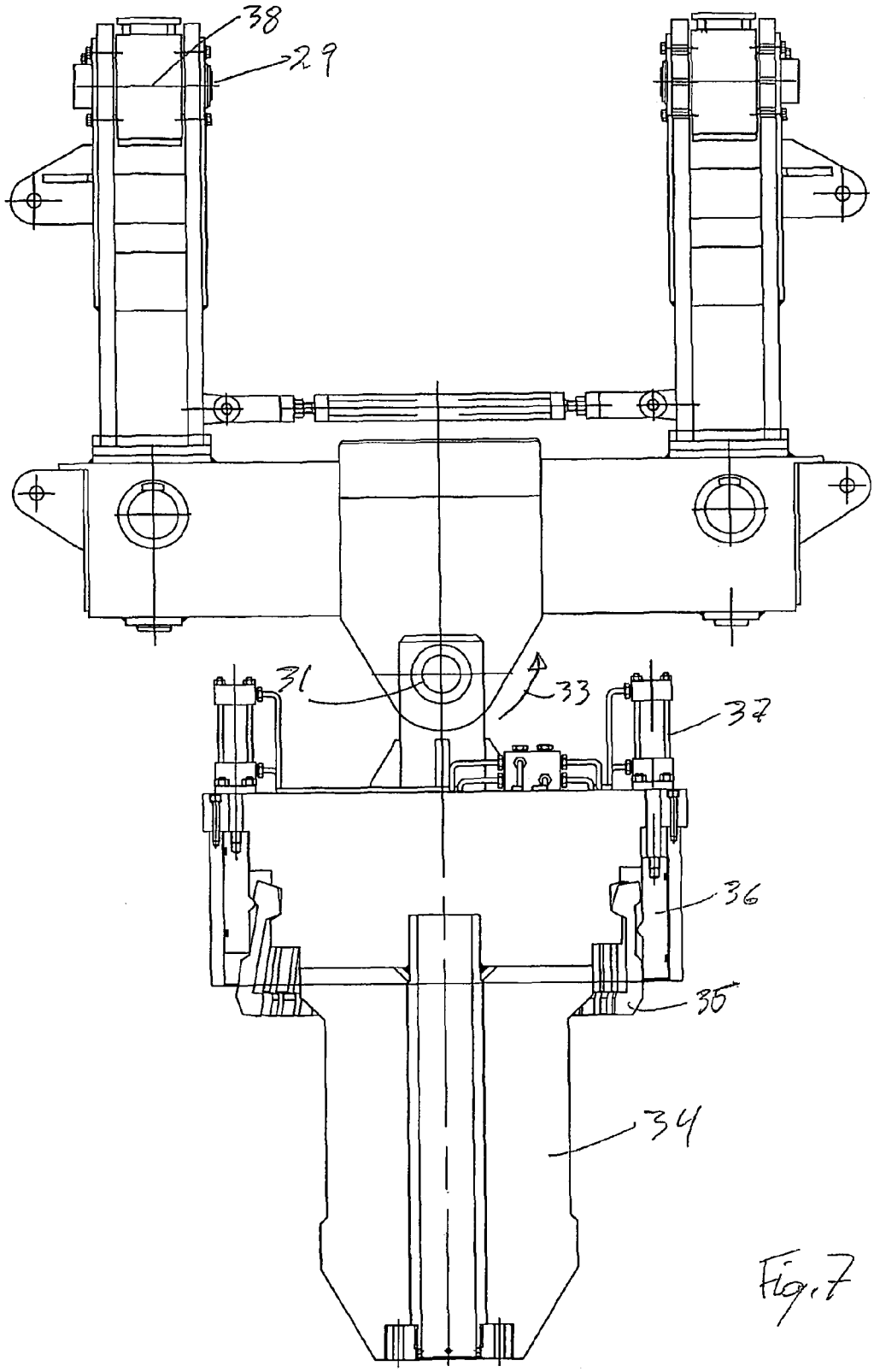

The invention will be explained in further detail, referring to the accompanying drawings that show exemplary embodiments of the invention, wherein:

FIG. 1 shows a vessel with tubular handling devices according to the present invention in side elevation view, FIG. 2 shows the vessel of FIG. 1 in plan view, FIG. 3*a* shows a detail of a storage device according to the present invention in plan view and in a first embodiment of the storage device, FIG. 3*b* shows a second embodiment of the storage device, FIGS. 4*a* and 4*b* show a detail of the catwalk of the present invention in side elevation view, shown in horizontal and vertical position, respectively, FIGS. 4*c-e* show the insertion and lifting of a tubular into the derrick, FIG. 4*f* shows the catwalk in cross section, FIG. 5 shows the catwalk of FIG. 4 in plan view, FIG. 6 shows a gripping head in side elevation view, and FIG. 7 shows a gripping head in side elevation view, perpendicular to FIG. 6.

Referring to FIGS. 1 and 2, the basic principles of the present invention will be described. In FIGS. 1 and 2 are shown a floating vessel 1, having a pair of floatation bodies 2, a platform deck 3 and a total of eight columns 4 extending between the floatation bodies 2 and the deck 3 to support the deck 3. On the deck 3 is a derrick 5 having a hoisting apparatus 6. On the deck 3 are also two cranes 7 of the knuckle boom type. The cranes 7 are all purpose cranes that can handle most of the lifting needs on the platform deck 3. The two cranes 7 will together cover the whole area of the deck 3. At the edge of the deck 3 are suspended four shafts 8, 9, 10, 11 that extend from the deck 3 to the floatation bodies 2. The shafts 8, 9, 10, 11 are designed as storage devices for tubulars, having a hollow interior adapted for receiving tubulars inserted vertically from above.

Close to the derrick 5 is situated a catwalk 12. The catwalk 12, the cranes 7 and the storage shafts 8, 9, 10, 11 are designed to co-operate in the handling of tubulars to and from the derrick 5.

In FIG. 3*a* is shown one of the shafts 8 in plan view from above. A plurality of tubulars 13 is stored in the shaft 8. At the top of the shaft is a lid 14 (the lid 14 is shown transparent in FIG. 3 so that the tubulars are visible). The lid protects the tubulars and the interior of the shaft 8 against the weather. In the lid 14 a guiding funnel 15 is arranged. The guiding funnel 15 is carried by a small trolley 16 that runs on tracks 17 at both sides of an elongate opening 18 in the lid 14. The tubulars are arranged in two concentric circles 19 and 20. The funnel 15 is capable of movement between the two circles 19, 20 by the trolley 16 and along the circles by rotation of the lid 14. To facilitate the rotation of the lid a motor 21 with a gear engaging a gear rim on the lid is arranged at the edge of the shaft 8. The guide is positioned over a selected one of the tubulars by indexing in polar co-ordinates, e.g. giving circle number 1 or 2 and the angular position along the circle.

FIG. 3*b* shows an alternative guiding means for the tubes in the shaft 22 is arranged moveable along a beam 23. The beam 23 forms a part of a trolley 24 that is moveable on tracks 25 at either side of the storage shaft 9. The tubulars 13 may also here be arranged in two concentric circles 19, 20 in the shaft 9. The guide 22 is capable of movement in x and y directions over the whole top of the shaft to be positioned over a selected one of the tubulars.

FIG. 4*a* shows the catwalk 12 and the lower part of the derrick 5. The catwalk 12 is a transporter that is adapted to feed pipes horizontally into the derrick 5 through a V-door (not shown) in the derrick 5. In FIG. 4*a* a pipe 26 in the form of a riser joint is lying on the catwalk 12. When the pipe has entered the V-door the hoist 6 of the derrick 5 is coupled to the end of the pipe 26 and the pipe is lifted from the catwalk into a vertical position.

The catwalk of the present invention is designed to be tilted into a vertical position, as shown in FIG. 4*b*. The function of this will be explained below.

FIG. 4*f* shows a cross section of the catwalk in FIG. 4*a*. It comprises a framework beam 40 that is pivotable at a hinge 41 in order to be tilted from a horizontal position into a vertical position, and vice versa.

In the framework beam is placed a skid 42 that can slide along the beam 40. The skid comprises a pipe bed 43 on which a tubular 26 may be placed. The skid has side supports 44, which at their free ends are equipped with rollers 45 that can be brought to engagement with the tubular 26 to prevent the tubular form moving out of the skid 42. When the tubular 26 is to be positioned on the skid 42 or lifted off from the skid 42, the rollers may be lifted to the position denoted by reference number 45'.

FIG. 5 shows the catwalk 12 and the derrick area in plan view. The derrick as such has been removed in order to show the area within the derrick 5.

FIGS. 6 and 7 show a grapple 27 designed to grip and hold a pipe, such shown in FIG. 4*a*. The grapple 27 is coupled to the boom 28 (se FIG. 1) of the knuckle boom cranes 7 via a joint 29. The joint 29 is preferably hydraulically driven to swing about a first axis 38 perpendicular to the boom 28, as shown by the arrow 30 in FIG. 6, The grapple 27 also comprises a second joint 31, that is hydraulically driven to swing about a second axis 32, which is perpendicular to the first axis 31, as shown by the arrow 33 in FIG. 7.

To grip the pipe, a head 34 on the grapple 27 is inserted in the pipe 26 at the end thereof. A set of dogs 35 is designed to grip a flange of the pipe (not shown). The dogs are operated hydraulically in a manner known per se, involving a ring 36 that is moved into and out of engagement with the dogs 36 by a set of hydraulic cylinders 37. In FIGS. 6 and 7 the dogs 36 are shown out of engagement with the pipe at the left hand side of the figures and in an engagement position at the right hand side of the figures.

The grapple 27 is designed to grip the pipe when the pipe is in a substantially vertical position. The pipe will be handled substantially vertically as the joints 29 and 31 are capable holding the grapple 27 in a vertical position. Due to wave induced movement of the rig 1, wind forces and unforeseen collisions with objects on the rig, excess forces may be imparted on the pipe, and hence the grapple. In order to avoid damage to the grapple 27, the grapple 27 is equipped with a hydraulic shear means. The shear means may be in the form of a relief valve releasing the hydraulic pressure at the joints 29 and 31, as known per se.

The function of the devices described above will now be explained.

The pipes, e.g., riser joints, are stored in the shafts 8, 9, 10, 11 at different locations along the perimeter of the deck 3. When a riser joint is to be used, one of the cranes 7, being the one covering the area of the shaft in which the riser joint is stored, e.g., the shaft 8, is driven to the shaft 8. At the same time the funnel 15 is brought to a position immediately above the riser joint. The grapple 27 is lowered into the funnel 15 and grips the riser joint.

If the riser joint is stored in a shaft 9 of the type shown in FIG. 3*b*, the brought to a position above the riser joint by the aid of the beam 23 and trolley 24.

The joints 29 and 31 of the grapple 27 are controlled so that the grapple is held in a substantially vertical position at all times. The booms of the knuckle boom crane 7 are also configured, as known per se, to move the grapple 27 along a vertical line. Hence, the riser joint may be extracted vertically out of the shaft 8.

The riser joint is then brought in the vertical position to the catwalk 12. The catwalk 12 is brought to the vertical position shown in FIG. 4*b*. In this position the catwalk receives the riser joint. Subsequently the catwalk is tilted to a substantially horizontal position. As this is done the catwalk is first lifted vertically my means not shown, so that the lower part of the catwalk clears the drill floor 46 of the derrick 5. In the horizontal position the skid 42 on the catwalk 12 transports the riser joint 26 in the direction of the drill centre, where the riser 26 is picked up by the elevator in the derrick 5 by means of a riser handling running tool in the derrick. As the upper end of the riser 26 is lifted up by the elevator, the trailing end runs on the skid 42 towards the drill centre, where it is guided with a hydraulically operated arm (not shown) into final alignment above the rotary.

When the tubular is to be returned from the derrick 5 to the shaft 8, 9, 10, 11, the sequence is the opposite of the above.

The invention claimed is:

1. System for storing a substantially vertical riser section and transporting the riser section between a vertical storage device and a catwalk or a derrick, comprising a vertical storage device for storing the riser section in a substantially vertical orientation, a crane constituting a single transport means for transporting the riser section between the vertical storage device and the catwalk or derrick, the crane being configured to grip the riser section and transport the riser section to the catwalk or derrick, wherein the vertical storage device comprises a shaft for storing the riser section in said substantially vertical orientation, the crane is a knuckle boom crane, which has a grapple that is adapted to be inserted inside an upper end of the substantially vertical riser section to grip the upper end of the riser section and wherein the crane is further adapted to lift the riser section, while the riser section is in said substantially vertical orientation, a substantially vertical distance at least corresponding to the length of the riser section and carry the riser section in said substantially vertical orientation from the vertical storage device to the catwalk or derrick, the crane being adapted to co-operate with a guiding means for guiding the riser section while it is being lifted out of the vertical storage device, further comprising a trolley for displacing the guiding means, the trolley running on first tracks at either side of an insertion and retrieving opening at a top end of the vertical storage device, the trolley comprising a beam extending substantially at a right angle to the first tracks and a second track on which the guide means is moveable in a direction substantially at a right angle to the first tracks, so that the guide means is movable with the trolley in a first direction parallel to said first tracks and in a second direction, perpendicular to said first direction, said movement being in a horizontal plane over top of all of the riser sections in the vertical storage device, and so that the riser sections disposed in the vertical storage device can be accessed by means of their x-y co-ordinates.

2. System according to claim 1, wherein the vertical storage device is positioned at the edge of a platform deck with said insertion and retrieving opening substantially at the level of the deck.

3. System according to claim 1, wherein the riser sections are arranged in two concentric circles in said vertical storage device.

4. A crane constituting a single transport means for transporting a substantially vertical riser section between a vertical storage and a catwalk or a derrick, wherein the crane is a knuckle boom crane, which has a grapple that is adapted to be inserted inside an upper end of the substantially vertical riser section to grip the upper end of the riser section and wherein the crane is further adapted to lift the riser section, while the riser section is in a substantially vertical orientation, a vertical distance at least corresponding to the length of the riser section out of the vertical storage and carry the riser section in said substantially vertical orientation from the vertical storage to the derrick or catwalk, the crane being adapted to co-operate with a guiding means for guiding the riser section while it is being lifted out of the vertical storage, further comprising a trolley for displacing the guiding means, the trolley running on first tracks at either side of an insertion and retrieving opening at a top end of the vertical storage device, the trolley comprising a beam extending substantially at a right angle to the first tracks and a second track on which the guide means is moveable in a direction substantially at a right angle to the first tracks, so that the guide means is movable with the trolley in a first direction parallel to said first tracks and in a second direction, perpendicular to said first direction, said movement being in a horizontal plane over top of all of the riser sections disposed in the vertical storage device, and so that the riser sections in the vertical storage device can be accessed by means of their x-y co-ordinates.

5. Device according to claim 4, wherein the riser sections are arranged in two concentric circles in said vertical storage device.

6. Use of a knuckle boom crane constituting a single transport means for transporting a substantially vertical riser section between a vertical storage and a catwalk or a derrick, including lifting the riser section, while the riser section is in a substantially vertical orientation, a substantially vertical distance at least corresponding to the length of the riser section out of the vertical storage, the knuckle boom crane having a grapple that is adapted to be inserted inside an upper end of the substantially vertical riser section to grip the upper end of the riser section and carry the riser section in said substantially vertical orientation from the vertical storage to the derrick or catwalk, the crane being adapted to co-operate with a guiding means for guiding the riser section while it is being lifted out of the vertical storage, further comprising displacing the guiding means with a trolley running on first tracks at either side of an insertion and retrieving opening at a top end of the vertical storage device, the trolley comprising a beam extending substantially at a right angle to the first tracks and a second track on which the guide means is moveable in a direction substantially at a right angle to the first tracks, so that the guide means is movable with the trolley in a first direction parallel to said first tracks and in a second direction, perpendicular to said first direction, said movement being in a horizontal plane over top of all of the riser sections disposed in the vertical storage device, and so that the riser sections in the vertical storage device can be accessed by means of their x-y co-ordinates.

7. A crane constituting a single transport means for transporting a substantially vertical riser section between a vertical storage and a catwalk or a derrick, wherein the crane is a knuckle boom crane, which has a grapple that is adapted to be inserted inside an upper end of the substantially vertical riser section to grip the upper end of the riser section and wherein the crane is further adapted to lift the riser section, while the riser section is in a substantially vertical orientation, a vertical distance at least corresponding to the length of the riser section out of the vertical storage and carry the riser section in said substantially vertical orientation from the vertical storage to the derrick or catwalk, the crane being adapted to co-operate with a guiding means for guiding the riser section while it is being lifted out of the vertical storage, wherein said guide means comprises a lid disposed to overlie a top end of the vertical storage device, the lid having a guide carried by a trolley that runs along an elongate opening in the lid, the lid being rotatable about a center axis thereof so as to dispose the elongate opening vertically above a riser section to be lifted by the crane, and so that the riser sections disposed in the vertical storage device can be accessed by means of their polar co-ordinates.

8. Device according to claim 7, wherein the trolley runs along tracks at both sides of said elongate opening.

9. Device according to claim 7, wherein the lid is rotated by a motor disposed adjacent said vertical storage device and having a gear engaging a gear rim on the lid.

10. Device according to claim 7, wherein the riser sections are arranged in two concentric circles in said vertical storage device.

11. Use of a knuckle boom crane constituting a single transport means for transporting a substantially vertical riser section between a vertical storage and a catwalk or a derrick, including lifting the riser section, while the riser section is in a substantially vertical orientation, a substantially vertical distance at least corresponding to the length of the riser section out of the vertical storage, the knuckle boom crane having a grapple that is adapted to be inserted inside an upper end of the substantially vertical riser section to grip the upper end of the riser section and carry the riser section in said substantially vertical orientation from the vertical storage to the derrick or catwalk, the crane being adapted to co-operate with a guiding means for guiding the riser section while it is being lifted out of the vertical storage, wherein said guide means comprises a lid disposed to overlie a top end of the vertical storage device, the lid having a guide carried by a trolley that runs along an elongate opening in the lid, the lid being rotatable about a center axis thereof so as to dispose the elongate opening vertically above a riser section to be lifted by the crane.

12. Use of a knuckle boom crane according to claim 11, wherein the trolley runs along tracks at both sides of said elongate opening.

13. Use of a knuckle boom crane according to claim 11, wherein the lid is rotated by a motor disposed adjacent said vertical storage device and having a gear engaging a gear rim on the lid.

14. Use of a knuckle boom crane according to claim 11, wherein the riser sections disposed in the vertical storage device are accessed by means of their polar co-ordinates.

15. System for storing a substantially vertical riser section and transporting the riser section between a vertical storage device and a catwalk or a derrick, comprising a vertical storage device for storing the riser section in a substantially vertical orientation, a crane constituting a single transport means for transporting the riser section between the vertical storage device and the catwalk or derrick, the crane being configured to grip the riser section and transport the riser section to the catwalk or derrick, wherein the vertical storage device comprises a shaft for storing the riser section in said substantially vertical orientation, the crane is a knuckle boom crane, which has a grapple that is adapted to be inserted inside an upper end of the substantially vertical riser section to grip the upper end of the riser section and wherein the crane is further adapted to lift the riser section, while the riser section is in said substantially vertical orientation, a substantially vertical distance at least corresponding to the length of the riser section and carry the riser section in said substantially vertical orientation from the vertical storage device to the catwalk or derrick, the crane being adapted to co-operate with a guiding means for guiding the riser section while it is being lifted out of the vertical storage device, wherein said guide means comprises a lid disposed to overlie a top end of the vertical storage device, the lid having a guide carried by a trolley that runs along an elongate opening in the lid, the lid being rotatable about a center axis thereof so as to dispose the elongate opening vertically above a riser section to be lifted by the crane, and so that the riser sections disposed in the vertical storage device can be accessed by means of their polar co-ordinates.

16. System according to claim 15, wherein the trolley runs along tracks at both sides of said elongate opening.

17. System according to claim 15, wherein the lid is rotated by a motor disposed adjacent said vertical storage device and having a gear engaging a gear rim on the lid.

18. System according to claim 15, wherein the riser sections are arranged in two concentric circles in said vertical storage device.

* * * * *